US006128028A

United States Patent [19]

Wen et al.

[11] Patent Number: 6,128,028

[45] Date of Patent: Oct. 3, 2000

[54] HEAT ASSISTED IMAGE FORMATION IN RECEIVERS HAVING FIELD-DRIVEN PARTICLES

[75] Inventors: Xin Wen, Rochester; Steven D. Maclean, Webster; William H. Simpson, Pittsford, all of N.Y.

[73] Assignee: Eastman Kodak Company, Rochester, N.Y.

[21] Appl. No.: 09/035,516

[22] Filed: Mar. 5, 1998

[51] Int. Cl.[7] ..... B41J 2/41

[52] U.S. Cl. ..... 347/112; 345/84; 345/85; 347/151

[58] Field of Search ..... 347/112, 113, 347/151; 345/84, 85, 107

[56] References Cited

U.S. PATENT DOCUMENTS

| | | | |
|---|---|---|---|
| 3,612,758 | 10/1971 | Evans et al. | 348/803 |
| 4,143,103 | 3/1979 | Sheridon | 264/4 |
| 5,344,594 | 9/1994 | Sheridon | 264/4.1 |
| 5,604,027 | 2/1997 | Sheridon | 428/323 |
| 5,975,680 | 11/1999 | Wen et al. | 347/43 |
| 5,982,346 | 11/1999 | Sheridon et al. | 345/85 |
| 6,054,071 | 4/2000 | Mikkelsen, Jr. | 264/1.36 |

FOREIGN PATENT DOCUMENTS

WO 97/04398 2/1997 WIPO .

OTHER PUBLICATIONS

"A Newly Developed Electrical Twisting Ball Display" by M. Saitoh, et al, pp. 249–253.

CRC Handbook of Chemistry and Physics, 72nd edition, edited by David R. Lide, CRC Press, Boca Raton, pp. 6–156–6–160.

*Primary Examiner*—Arthur T. Grimley
*Assistant Examiner*—William A. Noé
*Attorney, Agent, or Firm*—Raymond L. Owens

[57] ABSTRACT

A electronic printing apparatus includes memory for storing a digitized image. A receiver is transported to an image forming position, the receiver including field-driven particles in a matrix that can change reflective density in response to an applied electric field. The apparatus further includes an array of electrodes for selectively applying electric fields at the image forming position across the receiver; a heater for heating the receiver to increase the temperature of the matrix so as to increase the mobility of the field-driven particles in the matrix; and electronic control circuitry coupled to the array for selectively applying voltages to the array so that fields are applied at the image forming position to the heated field-driven particles at particular locations on the receiver corresponding to pixels in response to the stored image whereby the electrode produces an image in the receiver corresponding to the stored image in the receiver.

6 Claims, 2 Drawing Sheets

HEAT ASSISTED IMAGE FORMATION IN RECEIVERS HAVING FIELD-DRIVEN PARTICLES

CROSS REFERENCE TO RELATED APPLICATIONS

Reference is made to commonly assigned U.S. patent application Ser. No. 09/012,842 filed Jan. 23, 1998, entitled "Addressing Non-Emissive Color Display Device" to Wen et al; and U.S. patent application Ser. No. 09/035,606 filed on Mar. 5, 1998, entitled "Forming Images on Receivers Having Field-Driven Particles" to MacLean et al., now allowed. The disclosure of these related applications is incorporated herein by reference.

FIELD OF THE INVENTION

This invention relates to an electronic printing apparatus for producing images on a receiver comprising electric field-driven particles.

BACKGROUND OF THE INVENTION

There are several types of electric field-driven particles in the field of non-emissive displays. One class uses the so-called electrophoretic particle that is based on the principle of movement of charged particles in an electric field. In an electrophoretic receiver, the charged particles containing different reflective optical densities can be moved by an electric field to or away from the viewing side of the receiver, which produces a contrast in the optical density. Another class of electric field-driven particles are particles carrying an electric dipole. Each pole of the particle is associated with a different optical density (bi-chromatic). The electric dipole can be aligned by a pair of electrodes in two directions, which orient each of the two polar surfaces to the viewing direction. The different optical densities on the two halves of the particles thus produces a contrast in the optical densities.

To produce a high quality image it is essential to form a plurality of image pixels by varying the electric field on a pixel-wise basis. The electric fields can be produced by plural pairs of electrodes embodied in the receiver as disclosed in U.S Pat. No. 3,612.758. A shortcoming is that this solution requires the incorporation of electrodes in the receiver, increasing the receiver complexity.

Several features are needed in the above described non-emissive displays based on field-driven particles. It is desirable to reduce the writing time for producing an image on the display. It is also desirable for increasing the stability of the display after an image is produced.

SUMMARY OF THE INVENTION

It is an object of the present invention to provide an electronic printing apparatus for producing images on a receiver comprising electric field-driven particles in a time efficient fashion.

Another object of the present invention is to improve the image stability of the images formed by field-driven particles in a receiver.

These objects are achieved by an electronic printing apparatus, comprising:

a) storage means for storing a digitized image;

b) means for transporting a receiver, to an image forming position, the receiver including field-driven particles in a matrix that can change reflective density in response to an applied electric field;

c) an array of electrodes for selectively applying electric fields at the image forming position across the receiver;

d) a heater for heating the receiver to increase the temperature of the matrix so as to increase the mobility of the field-driven particles in the matrix; and e) electronic control means coupled to the array for selectively applying voltages to the array so that fields are applied at the image forming position to the heated field-driven particles at particular locations on the receiver corresponding to pixels of to the stored image whereby the electrode produces an image in the receiver corresponding to the stored image in the receiver.

ADVANTAGES

An advantage of the present invention is that a heater is provided to increase the mobility of the field-driven particles during and/or before an external electric field is applied to the field driven particles to produce the image pixels in a receiver.

An additional advantage is that the image formed by the field-driven particles on a receiver is stabilized by a viscous fluid that contain the field-driven particles.

DETAILED DESCRIPTION OF THE INVENTION

Figure 1:
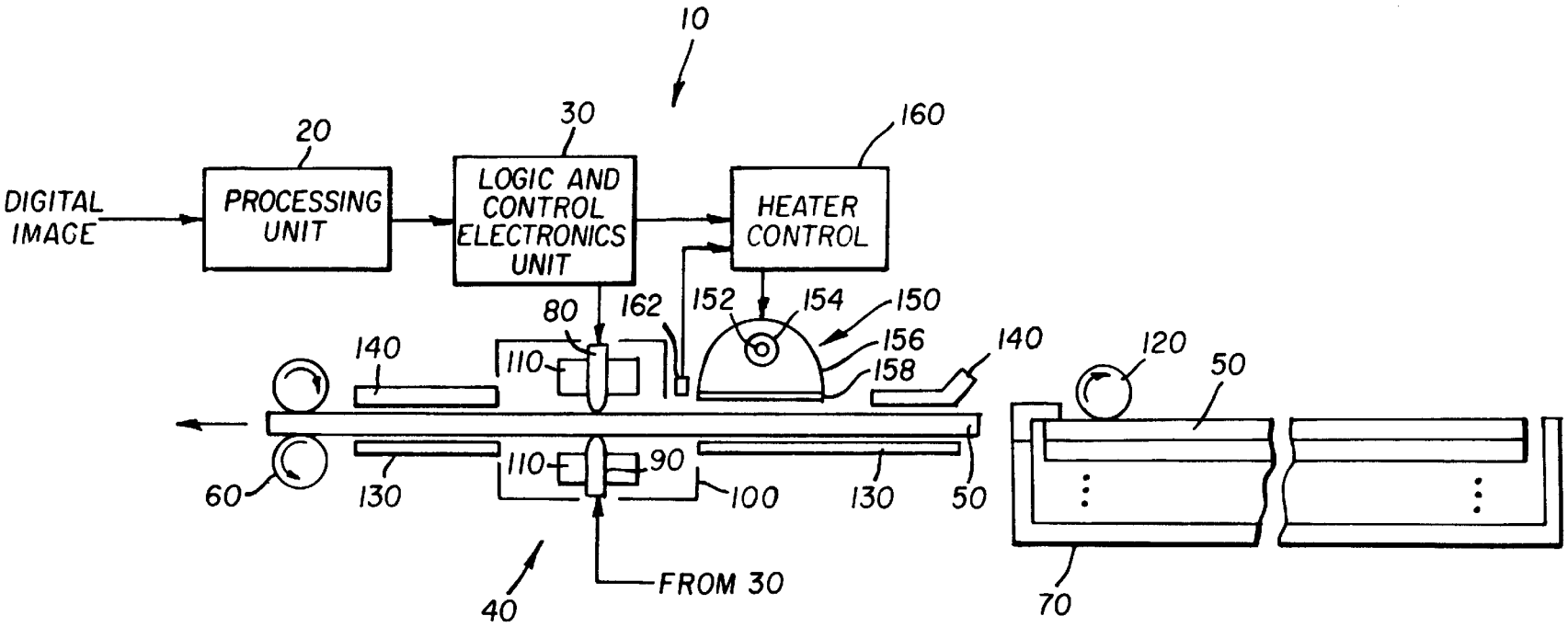
FIG. 1 shows the electronic printing apparatus 10 in accordance to the present invention.

FIG. 1 shows the electronic printing apparatus 10 in accordance to the present invention. The electronic printing apparatus 10 includes a processing unit 20, a logic and control electronics unit 30, a print head 40, a receiver 50 that comprises electric field-driven particles in a matrix (see FIG. 3), a receiver transport 60, and a receptacle 70. The print head 40 includes an array of pairs of top electrodes 80 and bottom electrodes 90 (only one pair being shown) corresponding to each pixel of the image forming position on the receiver 50. The array of electrodes is contained in an electrode structure 110. The electrode structure 110 is formed using polystyrene as an insulating material. It is known that other insulating materials including ceramics and plastics can be used. An electric voltage is applied by logic and control electronics unit 30 across the pair of electrodes at each pixel location to produce the desired optical density at that pixel. An electrically grounded shield 100 is provided to shield print head 40 from external electric fields.

The receiver 50 is shown to be picked by a retard roller 120 from the receptacle 70. Other receiver feed mechanisms are also compatible with the present invention: for example, the receiver can be fed by single sheet or by a receiver roll equipped with cutter. The term "receptacle" will be understood to mean a device for receiving one or more receivers including a receiver tray, a receiver roll holder, a single sheet feed slot etc. During the printing process, the receiver 50 is supported by the platen 130 and guided by the guiding plate 140, and is transported by the receiver transport mechanism 60.

The electronic printing apparatus 10 in FIG. 1 is shown to further include a heater 150 and a heater control circuit 160.

The heater 150 includes a heating element 152, a tube 154, a reflector 156 and a cover 158. The heater 150 is controlled by the heater control circuit 160 for providing thermal energy to receiver 50 before and/or during an electric field is applied to an area on the receiver 50 by electrodes 80 and 90. The purpose of the heater 150 is to increase the mobility of the electric field driven particles 200 (FIG. 3) by increasing the temperature in the matrix 230 in the receiver 50 (FIG. 3). As it is well known in the art, the viscosities of the most common fluids comprising low molecular weight molecule or polymers decrease as the temperature increases (see for example, CRC Handbook of Chemistry and Physics edited by David R. Lide, CRC Press, Boca Raton). The mobility of colloidal particles driven by an external field is inversely proportional to the viscosity of the fluid the particles are immersed in. Thus decreased visocity in the fluid 210 increases the mobility of the electric field-driven particles 200 in the electric field (FIG. 3). After the electric field is applied to the field-driven particles at each pixel, the field-driven particles are away from the heater and the temperature decreases. The viscosity of the fluid increases and the mobility of the field-driven particles are reduced. The spatial and orientational configuration of the field-driven particles are fixed for a stable display image.

The heater 150 in FIG. 1 is shown to be a radiant heater in which the heating element 152 can be a coiled electrically resistive wire and the tube 154 can be made of quartz. The heating element 152 is surrounded by the tube 154 for protecting the heating element 152 from damage. The tube 154 also provides physical support to the entire length of the heating element 152. In addition, the tube 154 electrically insulates the heating element 154 from the surroundings and protects the heating element 152 from damaging other components in the heater 150. The material selected for heating element 152 and tube 154 should possess durability at high temperature through a multiplicity of thermal cycles. Examples of such materials as suitable for use heating element 152 are "NICHROME", a Nickel-Chromium Alloy, and iron chromium aluminum alloys. "NICHROME" is a trademark of Driver-Harris Company located in Harrison, N.J. Tube 154 may be quartz. It is appreciated by a person of ordinary skill in the art that metal sheathed heating elements or exposed wire heaters may also be used. Electrical current flowing through heating element 152 causes heating element 152 to heat, thereby generating radiant heat emanating therefrom.

Although a radiant heater is described above in relation to FIG. 1, it is understood that many other heater types are compatible with the present invention. For example, the heater can include contact type, a convection type etc.

The heating element 152 and the tube 154 in the heater 150 are shown to be housed in a reflector 156 that is made of a substantially reflective material, such as polished aluminum, partially surrounds tube 154. The reflector 156 is preferably parabolic-shaped and is arranged so as to reflect the radiant heat energy onto the receiver 50. The reflector 156 preferably reflects the heat at a high thermal efficiency ratio. As used herein, the terminology "thermal efficiency ratio" is defined to mean the quantity of heat energy reaching receiver 50 divided by the quantity of total heat energy emitted by heating element 152.

The cover 158 is a substantially heat transparent. It is disposed across the open side of the reflector 156. The cover 158 may be a metal screen or sheet metal with punched holes for preventing receiver 50 from inadvertently contacting tube 154 while simultaneously allowing a sufficient quantity of radiant heat flux to pass through. A sensor 162 which senses the temperature adjacent to the receiver 50 in the image forming position, provides a signal to the heater control circuit 160 representative of the temperature of the receiver 50. The sensor 162 monitors the temperature at the receiver 50 and the heater control circuit 160 adjusts the amount of the electric power applied by the heater 150, which determines the thermal energy applied to the receiver 50. A typical temperature range sensed by the sensor 162 is 30° C. to 100° C. The logic and control electronics unit 30 responds to the processing unit 20 and turns on the heat control circuit 160 before the processing unit delivers image data to the logic and control electronics units 30 for application to top electrodes 80. Before the logic and control electronics unit 30 delivers data to the electrodes 80 and 90, the temperature sensed by sensor 162 reaches a sufficient level indicating that the mobility of the field-driven particles in the matrix of the receiver 50 is high enough for efficient printing.

Figure 2:
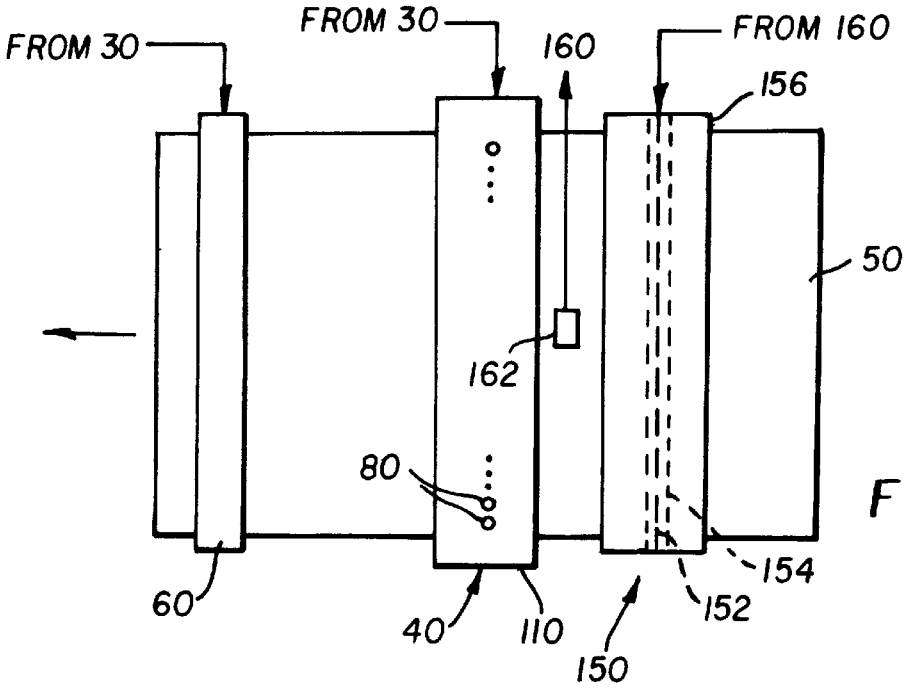
FIG. 2 shows a top view of the structure around the print head 40.

FIG. 2 shows a top view of the structure around the print head 40. For clarity reasons, only selected components are shown. The receiver 50 is shown to be transported under the print head 40 by the receiver transport mechanism 60. The print head 40 is shown to include a plurality of top electrodes 80, each corresponding to one pixel. The top electrodes 80 are located within holes in the electrode structure 110. The bottom electrodes 90 of FIG. 1 are also disposed in an electrode structure 110. The electrodes are distributed in a linear fashion as shown in FIG. 2 to minimize electric field fringing effects between adjacent pixels printed on the receiver 50. Different printing resolutions are achievable across the receiver 50 by the different arrangements of the top electrodes 80, including different electrode spacing. The printing resolution down the receiver 50 can also be changed by controlling the receiver transport speed by the receiver transport mechanism 60 or the rate of printing by controlling the logic and control electronics unit 30. The heater 150, that is controlled by heater control circuit 160, is shown upstream to the print head 40. The heating element 152 and the tube 154 are also shown.

Figure 3A:
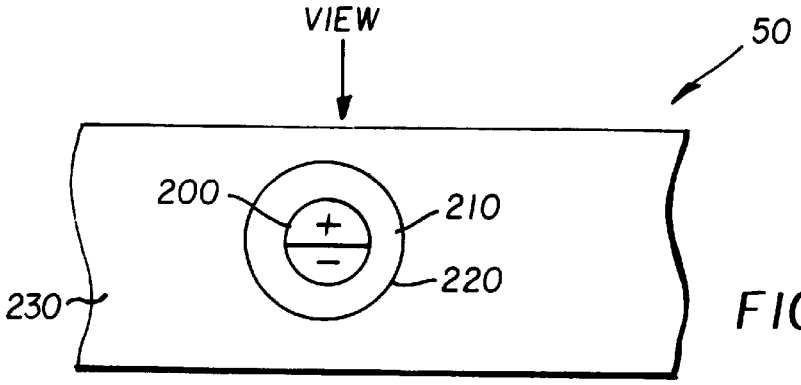
FIGS. 3*a* and 3*b* show a cross sectional view of the receiver 50 of FIG. 1.
Figure 3B:
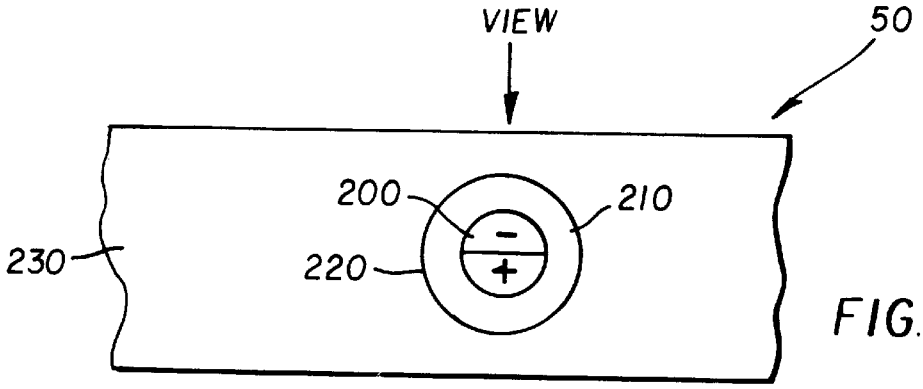

FIGS. 3*a* and 3*b* show a cross sectional view of the receiver 50 of FIG. 1. The receiver 50 is shown to comprise a plurality of electric field-driven particles 200. The electric field-driven particles 200 are exemplified by bi-chromatic particles, that is, half of the particle is white and the other half is of a different color density such as black, yellow, magenta, cyan, red, green, blue, etc. The bi-chromatic particles are electrically bi-polar. Each of the color surfaces (e.g. white and black) is aligned with one pole of the dipole direction. The stable electric field-driven particles 200 are suspended in a fluid 210 which are together encapsulated in a microcapsule 220. The materials for fluid 210 can be oil and are also disclosed in the prior art below. The microcapsules 220 are immersed in matrix 230. An electric field induced in the microcapsule 220 align the field-driven particles 200 to a low energy direction in which the dipole opposes the electric field. When the field is removed the particles state remains unchanged. FIG. 3*a* shows the particle 200 in the white state as a result of field previously imposed by a negative top electrode 80 of FIG. 1 and positive bottom electrode 90 of FIG. 1. FIG. 3*b* shows the particle 200 in the black state as a result of field previously imposed by a positive top electrode 80 of FIG. 1 and negative bottom electrode 90 of FIG. 1. The receiver 50 shown here is less complex than the prior art receiver structures comprising field-driven particles and addressing electrodes.

The field-driven particles can include many different types, for example, the bi-chromatic dipolar particles and electrophoretic particles. In this regard, the following disclosures are herein incorporated in the present invention. Details of the fabrication of the bi-chromatic dipolar particles and their addressing configuration are disclosed in U.S. Pat. Nos. 4,143,103; 5,344,594; and 5,604,027; and in "A Newly Developed Electrical Twisting Ball Display" by Saitoh et al p249–253, Proceedings of the SID, Vol. 23/4, 1982, the disclosure of these references are incorporated herein by reference. Another type of field-driven particle is disclosed in PCT Patent Application WO 97/04398. It is understood that the present invention is compatible with many other types of field-driven particles that can display different color densities under the influence of an electrically activated field.

Referring to FIG. 1, a typical operation of the electronic printing apparatus 10 is described in the following. A user sends a digital image to processing unit 20. Processing unit 20 receives the digital image storing it in internal storage. All processes are controlled by processing unit 20 via logic and control electronics unit 30. A receiver 50 is picked from receptacle 70 by retard roller 120. The receiver 50 is advanced until the leading edge engages receiver transport 60. Retard roller 120 produces a retard tension against receiver transport 60 which controls receiver 50 motion. The receiver 50 is heated by heater 150 before or during an image area is written by print head 40. The amount of the heating power is controlled by heater control circuit 160. The heater applies thermal energy to the receiver 50 and raises the temperature of the fluid 210 in the microcapsule 220 (FIG. 3), which decreases the viscosity of the fluid 210. The decreased viscosity in fluid 210 increases the mobility of the field-driven particles 200. The increased mobility of the field-driven particles 200 decreases the response time of the field-driven particles 200 when an image area on the receiver 50 is applied with an electric field by the print head 40 as described previously and below.

The logic and control electronics unit 30 is in communication with the heater control circuit 160. The heating power of the heater 150, the writing time of the print head 40, and the electric voltage across the top electrode 80 and the bottom electrode 90 can be optimized for the most desired image quality and printing productivity of the electronic printing apparatus 10.

As the receiver 50 is moved past the image forming position between the array of pair of electrodes, each pixel of the digital image produced by an electric field applied by the pair of the electrodes, top electrode 80 and bottom electrode 90. Each pair of electrodes is driven complimentarily, bottom electrode 90 presents a voltage of opposite polarity to the voltage produced by top electrode 80, each voltage referred to as ground. Each pixel location is driven according to the input digital image to produce the desired optical density as described in FIGS. 3*a* and 3*b*. The pixel data is selected from the digital image data to adjust for the relative location of each electrode pair and transport motion. The receiver transport 60 advances the receiver 50 a displacement which corresponds to a pixel pitch. The next set of pixels are written according to the current position. The process is repeated until the entire image is written. The retard roller 120 disengages as the process continues and the receiver transport 60 continues to control receiver 50 motion. The receiver transport 60 moves the receiver 50 out of the electronic printing apparatus 10 to eject the print. The receiver transport 60 and the retard roller 120 are close to the image forming position under the electrodes 80 and 90, this improves control over the receiver motion and improves print quality.

After an image is written by the print head 40, the fluid 210 in the microcapsule 220 is cooled down and the mobility of the field-driven particles 200 is reduced, which helps to stabilize the image on the receiver 50.

The invention has been described in detail with particular reference to certain preferred embodiments thereof, but it will be understood that variations and modifications can be effected within the spirit and scope of the invention.

What is claimed is:

1. An electronic printing apparatus, comprising:

a) storage means for storing a digitized image;

b) means for transporting a receiver to an image forming position, the receiver including field-driven particles in a matrix that can change reflective density in response to an applied electric field;

c) an array of electrodes for selectively applying electric fields across the receiver at the image forming position;

d) a heater for heating the receiver to increase the temperature of the matrix so as to increase the mobility of the field-driven particles in the matrix; and e) electronic control means coupled to the array of electrodes and responsive to the stored digitized image for selectively applying voltages to the heated field-driven particles at particular locations on the receiver corresponding to pixels of the stored image whereby the array of electrodes causes an image to be produced in the receiver corresponding to the stored digitized image in the storage means.

2. The electronic printing apparatus of claim 1 wherein the array is a linear array of spaced electrodes.

3. The electronic printing apparatus of claim 1 wherein the electronic control means includes logic and control means responsive to the digitized image for controlling the operation of the transporting means and the application of voltages to the array.

4. The electronic printing apparatus of claim 1 further comprising a heater control unit for controlling the electric power of the heater.

5. The electronic printing apparatus of claim 4 further comprising a sensor for providing an electrical signal representing the temperature of the field-driven particles to the heater control unit.

6. The electronic printing apparatus of claim 1 wherein the heater is radiant type.

* * * * *